United States Patent [19]

Nash et al.

[11] Patent Number: 4,777,344

[45] Date of Patent: Oct. 11, 1988

[54] THIN FUR LINED JACKET

[76] Inventors: Dwight V. Nash, 420 Ashby St. #358, Atlanta, Ga. 30310; George Spector, 233 Broadway RM 3815, New York, N.Y. 10007

[21] Appl. No.: 76,901

[22] Filed: Jul. 23, 1987

[51] Int. Cl.[4] ..... H05B 3/56

[52] U.S. Cl. ..... 219/211; 219/527; 219/529; 219/549

[58] Field of Search ..... 219/211, 212, 527, 528, 219/529, 548, 549

[56] References Cited

U.S. PATENT DOCUMENTS

| | | | |
|---|---|---|---|
| 1,272,332 | 7/1918 | Charles | 219/528 |
| 1,358,509 | 11/1920 | Birkenfeld | 219/529 |
| 1,691,472 | 11/1928 | Graham | 219/527 |
| 2,277,772 | 3/1942 | Marick | 219/527 |
| 2,329,766 | 9/1943 | Jacobsen | 219/528 |
| 3,729,613 | 4/1973 | Deloire | 219/527 |
| 3,748,436 | 7/1973 | Cossaboom | 219/527 |
| 4,404,460 | 9/1983 | Kerr | 219/211 |

*Primary Examiner*—H. Broome
*Assistant Examiner*—Teresa J. Walberg

[57] ABSTRACT

An electrically heated jacket is provided that includes a garment with a pair of attachable gloves and hood mask all connectable to a heating element supplied by a portable power source worn on the jacket to emit heat to torso, arms, hands and head of wearer of the jacket. The garment contains thermally insulating material to sustain body heat.

1 Claim, 1 Drawing Sheet

THIN FUR LINED JACKET

BACKGROUND OF THE INVENTION

The instant invention relates generally to garments and more specifically it relates to an electrically heated jacket.

Numerous garments have been provided in prior art that are adapted to contain electrical heating elements built within to supply heat thereto. For example, U.S. Pat. Nos. 3,084,241; 3,501,616 and 3,519,791 all are illustrative of such prior art. While these units may be suitable for the particular purpose to which they address, they would not be as suitable for the purposes of the present invention as heretofore described.

SUMMARY OF THE INVENTION

A primary object of the present invention is to provide an electrically heated jacket that will overcome the shortcomings of the prior art devices.

Another object is to provide an electrically heated jacket that includes a pair of gloves and ski-mask all connected to a heating element supplied by a portable power source such as a battery to emit heat to torso, arms, hands and head of a person wearing the jacket.

An additional object is to provide an electrically heated jacket that includes thermo insulating material such as fur and the like to substain body heat in even extremely cold weather conditions.

A further object is to provide an electrically heated jacket that is simple and easy to use.

A still further object is to provide an electrically heated jacket that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
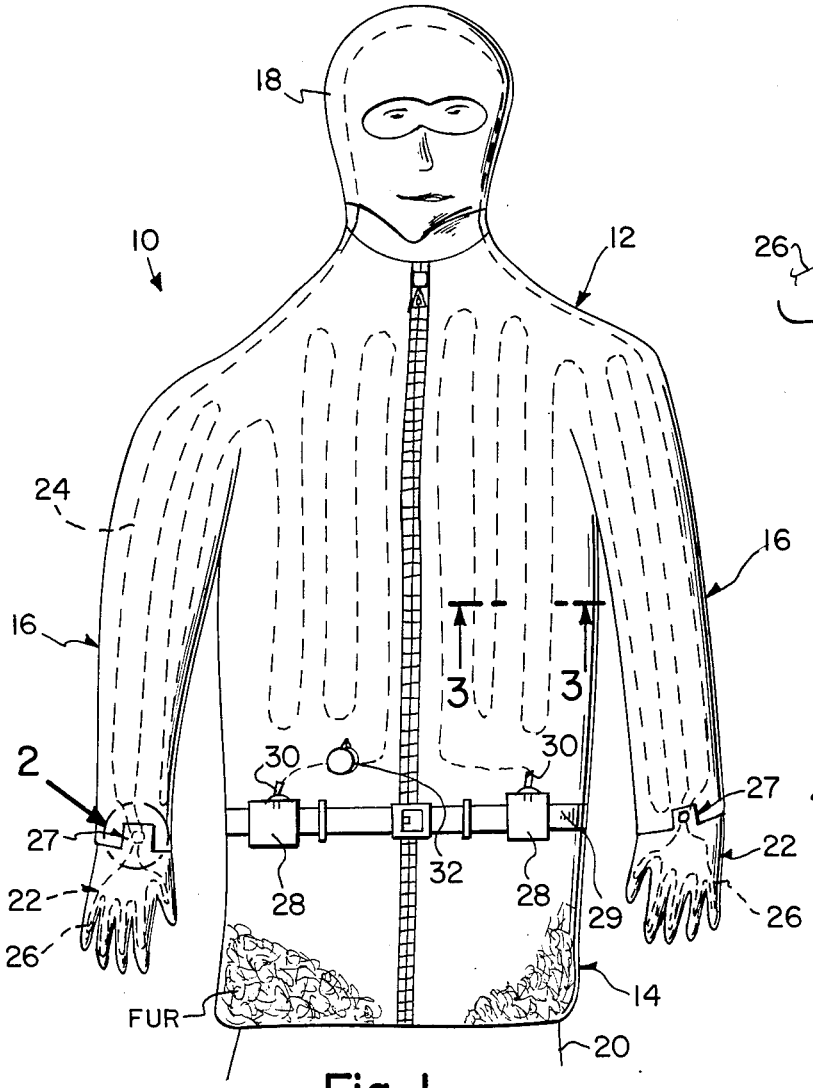
FIG. 1 is a front elevational view of the invention.

Turning now descriptively to the drawings, in which similar reference characters denote similar elements throughout the several views, FIG. 1 illustrates an electrically heated jacket 10 that consists of a flexible insulating garment 12 that has a body 14, sleeves 16 and hood mask 18 for covering torso, arms and head of wearer 20 of the jacket 10. A pair of flexible insulating gloves 22 are also provided for covering hands of the wearer 20 of the jacket 10. A thin flexible elongated electric resistance heating elements 24 is incorporated in the garment 12 in heat transfer relation to the torso, arms and head of the wearer 20 of the garment 12. A pair of thin flexible elongated electric resistance heating elements 26 are each incorporated in each of the gloves 22 in heat transfer relation to the hands of the wearer 20 of the gloves 22. The gloves 22 are electrically connected to the garment 12 by connecting devices 27. A portable source of electrical energy is provided for the heating elements 24 and 26 and includes batteries 28 on belt 29, electrical conductors 30 extending from the batteries 28 to the heating element 24 in the garment 12 and a thermostatic control unit 32 is electrically connected in circuit with one of the batteries 28.

Figure 2:
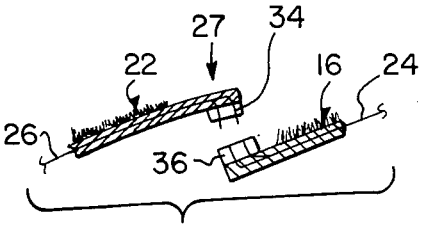
FIG. 2 is a cross sectional view as indicated by numeral 2 in FIG. 1 showing the plug in connector on the glove.
Figure 4:
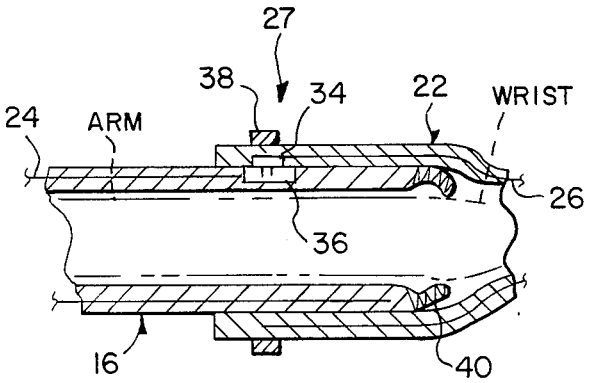
FIG. 4 is a cross sectional view of a modification showing an improved means of connecting the glove to the sleeve of the garment.

As best shown in FIG. 2, each of the connecting devices 27 includes a male plug 34 on underside end of the glove 22 and a female socket 36 near cuff of the sleeve 16 of the garment 12. As shown in FIG. 4 a strap 38 can be affixed near the end of the glove 22 and an elastic band 40 can be affixed to the cuff of the sleeve 16 of the garment 12 to enhance connection of the glove 22 to the sleeve 16 of the garment 12 with reduction of heat loss.

Figure 3:
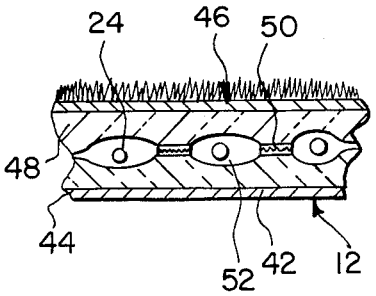
FIG. 3 is an enlarged cross sectional view taken along line 3—3 in FIG. 2 showing the material within the jacket in detail.

As best seen in FIG. 3, the garment 12 further contains an inner flexible lining 42 that has a first layer of electric insulating material 44. An outer flexible fur coating 46 is provided and has a second layer of electrical insulating material 48. A plurality of hook and loop fastener strips 50 are also provided, with each pair affixed to the first layer 44 and second layer 48 of electrical insulating material between the heating element 24 to form a plurality of air space ducts 52 which can be heated by the heating element 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An electrically heated jacket, which comprises:

(a) a flexible insulating garment having a body, sleeves and hood for covering torso, arms and heat of wearer of said jacket;

(b) a pair of flexible insulating gloves for covering hands of the wearer of said jacket;

(c) a thin flexible elongated electric resistance heating element incorporated in said garment in heat transfer relation to the torso, arms and head of the wearer of said garment;

(d) a pair of thin flexible elongated electric resistance heating elements, each of which is incorporated in one of said gloves in heat transfer relation to the hands of the wearer of said gloves;

(e) means for electrically connecting said gloves to said garment; and (f) a portable source of electrical energy for said heating elements including a battery, electrical conductor extending from said battery to said heating element in said garment and a thermostatic control electrically connected in circuit with said battery, wherein each of said connecting means is a plug in connector that includes:

(g) a male plug on underside of said glove;

(h) a female socket near a cuff of the sleeve of said garment;

(i) a strap affixed near the end of said glove;

(j) an elastic band affixed to the cuff of the sleeve of said garment to enhance connection of said glove to the sleeve of said garment with reduction of heat loss;

(k) an inner flexible lining having a first layer of electric insulating material;

(l) an outer flexible fur coating having a second layer of electrical insulating material; and (m) a plurality of pairs of mating hook and loop type fastener strips, with each pair affixed to said first layer and second layer of insulating material between portions of said heating element to form a plurality of air space ducts which can be heated by said heating element.

* * * * *